US011591661B2

(12) United States Patent
Keller et al.

(10) Patent No.: US 11,591,661 B2
(45) Date of Patent: Feb. 28, 2023

(54) HIGH PURITY LACTOSE

(71) Applicant: Keller Technologies, Inc., Marshfield, WI (US)

(72) Inventors: A. Kent Keller, Mantorville, MN (US); James P. Mullen, Rochester, MN (US); Eric A. Keller, Valatie, NY (US)

(73) Assignee: Keller Technologies, Inc., Marshfield, MN (US)

( * ) Notice: Subject to any disclaimer, the term of this patent is extended or adjusted under 35 U.S.C. 154(b) by 652 days.

(21) Appl. No.: 16/341,188

(22) PCT Filed: Oct. 12, 2017

(86) PCT No.: PCT/US2017/056334
§ 371 (c)(1),
(2) Date: Apr. 11, 2019

(87) PCT Pub. No.: WO2018/071665
PCT Pub. Date: Apr. 19, 2018

(65) Prior Publication Data

US 2020/0190608 A1 Jun. 18, 2020

Related U.S. Application Data

(60) Provisional application No. 62/408,580, filed on Oct. 14, 2016.

(51) Int. Cl.
*C13K 5/00* (2006.01)

(52) U.S. Cl.
CPC ..... *C13K 5/00* (2013.01)

(58) Field of Classification Search
None
See application file for complete search history.

(56) References Cited

U.S. PATENT DOCUMENTS 2,413,055 A * 12/1946 Leviton ..... A61K 31/525 544/251
4,342,604 A * 8/1982 Evans ..... C13K 5/00 127/31

(Continued)

FOREIGN PATENT DOCUMENTS

CN 101480608 A * 7/2009
DE 4113836 A1 1/1992

(Continued)

OTHER PUBLICATIONS

CN-101480608-A—English translation (Year: 2009).*

(Continued)

*Primary Examiner* — Stefanie J Cohen
(74) *Attorney, Agent, or Firm* — Shumaker & Sieffert, P.A.

(57) ABSTRACT

An example system for purifying a supply stream including lactose includes a clarification system configured to separate insoluble impurities from the stream to produce a clarified stream. The system includes an adsorption system fluidically coupled to the clarification system. The adsorption system includes an adsorbent resin configured to purify the clarified stream. An example technique for purifying a supply stream including lactose includes separating insoluble impurities from the supply stream to produce a clarified stream and passing the clarified stream over an adsorbent resin to produce a decolorized stream.

17 Claims, 2 Drawing Sheets

(56) References Cited

U.S. PATENT DOCUMENTS

| | | | | |
|---|---|---|---|---|
| 4,950,332 | A * | 8/1990 | Stringfield | A23L 2/78 127/46.2 |
| 2004/0132989 | A1 | 7/2004 | Lifran et al. | |
| 2008/0021186 | A1* | 1/2008 | Steib | C08F 10/00 526/348.3 |
| 2013/0266991 | A1* | 10/2013 | Kanamori | C12P 19/14 435/99 |

FOREIGN PATENT DOCUMENTS

| | | | |
|---|---|---|---|
| EP | 0249368 | A2 | 12/1987 |
| WO | 91/03574 | A1 | 3/1991 |
| WO | 2016/122887 | A1 | 8/2016 |

OTHER PUBLICATIONS

Bekkum et al, Carbohydrates as Organic Raw Materials, p. 96 (Year: 1996).*
Office Action from counterpart CA Application No. 3,040,249 dated Nov. 12, 2020, 3 pgs.
Response to Examination Report from counterpart NZ Application No. 752945 dated May 20, 2020, filed Sep. 30, 2020, 7 pgs.
Examination Report 3 from counterpart NZ Application No. 752945 dated Jan. 13, 2021, 1 pg.
Notice of Allowance from counterpart Canadian Application No. 3,040,249, dated Jun. 7, 2021, 1 pp.
International Search Report and Written Opinion of International Application No. PCT/US2017/056334, dated Dec. 18, 2017, 16 pp.
"DOWEX (TM) Optipore (TM) SD-2 Adsorbent Product Information," Trademark of The Dow Chemical Company ("DOW") or an affiliated company of DOW, retrieved from URL:http://msdssearch.dow.com/PublishedliteratureDOWCOM/dh_0200/0901b803802009ea.pdf?filepath=liquidseps/pdfs/noreg/177-81666.pdf&fromPage=GetDoc, Form No. 177-01666-0209, Dec. 8, 2017, 2 pp.
Notice of Acceptance from counterpart Australian Application No. 2017342361, dated May 21, 2020, 3 pp.
Office Action from counterpart Canadian Application No. 3,040,249, dated Apr. 20, 2020, 4 pp.
Office Action from counterpart European Application No. 17797475.5, dated Apr. 17, 2020, 6 pp.
First Examination Report from counterpart New Zealand Application No. 752945, dated May 20, 2020, 3 pp.
Response to Canadian Office Action dated Nov. 12, 2020, from counterpart Canadian Patent Application No. 3,040,249, filed Mar. 11, 2021, 5 pp.
Notice of Intent to Grant and Text Intended to Grant from counterpart European Application No. 17797475.5, dated Mar. 11, 2021, 29 pp.
Examination Report for counterpart AU Application No. 2017342361 dated Nov. 1, 2019, 4 pgs.
Response to Official Action from counterpart CA Application No. 3,040,249 dated Apr. 20, 2020, filed Aug. 19, 2020, 22 pp.
Response to Office Action from counterpart European Application No. 17797475.5, dated Apr. 17, 2020, filed Jul. 24, 2020, 31 pp.
Response to First Examination Report from counterpart New Zealand Application No. 752945, dated May 20, 2020, filed Sep. 30, 2020, 7 pp.
Second Examination Report from counterpart New Zealand Application No. 752945, dated Oct. 7, 2020, 4 pp.
International Preliminary Report on Patentability from International Application No. PCT/US2017/056334, dated Apr. 25, 2019, 8 pp.

* cited by examiner

HIGH PURITY LACTOSE

CROSS REFERENCE TO RELATED APPLICATIONS

This application is a national stage entry under 35 U.S.C. § 371 of PCT Application No. PCT/US2017/056334, filed Oct. 12, 2017, which claims the benefit of U.S. Provisional Patent Application Ser. No. 62/408,580, titled "HIGH PURITY LACTOSE," which was filed on Oct. 14, 2016. The entire contents of PCT Application No. PCT/US2017/056334 and U.S. Provisional Patent Application Ser. No. 62/408,580 are incorporated herein by reference.

BACKGROUND

The milk sugar lactose can be produced by concentrating cheese whey or de-proteinized cheese whey, cooling the concentrate to force crystallization of the lactose contained in the whey, separating the crystals from the balance of the whey constituents, purifying the crystals through washing with water, and drying the washed crystals.

Dried lactose product obtained from dairy processing, referred to herein as edible grade lactose, may be used as an energy source, for example, in simulated milk formulations for infants and for baby animals and is used as an ingredient in various confections. Lactose may also be used in pharmaceutical applications, for example, as an excipient in pharmaceutical formulations. However, the purity of lactose required by the pharmaceutical industry is higher than the purity associated with edible grade lactose.

The impurities found in edible grade lactose that typically render it unsuitable for pharmaceutical applications include insoluble impurities and riboflavin. The insoluble impurities may include calcium salts and denatured proteins. Riboflavin, which may be found in milk, whey and permeate, may adsorb to the surface of lactose crystals and impart a yellow color to dried edible grade lactose and to solutions of edible grade lactose. Pharmaceutical grade, high purity lactose may be produced by removing riboflavin and the insoluble impurities found in edible grade lactose. Pharmaceutical grade lactose is substantially white and forms a clear, colorless aqueous solution.

A technique for purifying edible grade lactose may include adding activated carbon to a solution of edible grade lactose to remove the riboflavin by adsorption onto the activate carbon, followed by filtering the solution to remove the insoluble impurities and the activated carbon, evaporating the purified solution, crystallizing lactose, and drying the lactose crystals. Riboflavin may also be removed from lactose using a food grade adsorbent resin such as Amberlite FPX66 resin (Rohm and Hass, Philadelphia, Pa.).

SUMMARY

The traditional process for producing high purity (e.g. pharmaceutical grade) lactose uses activated carbon and is labor intensive. Furthermore, the filtration step required to remove the activated carbon requires pre-coating a filter with a filter aid. The filter aid along with the activated carbon and insoluble impurities are solid waste by-products which require disposal. Any voids in the filter aid or a malfunction of the vacuum filter can allow contamination of the previously clarified batch of lactose.

Food-grade adsorbent resins such as Amberlite FPX66 are not currently FDA-approved for production of high purity lactose intended to be consumed, for example, in infant formula, pharmaceutical formulations, and other such products.

The present disclosure describes efficient and commercially useful systems and techniques for purifying lactose, for example, edible grade lactose, to obtain high purity lactose suitable for edible and pharmaceutical applications.

In one embodiment, the disclosure describes a system for purifying a supply stream including lactose. The system includes a clarification system configured to remove insoluble impurities from the supply stream to produce a clarified stream. The system also includes an adsorption system that includes an adsorbent resin. The adsorbent resin in the adsorption system removes colorants or contaminants, for example, riboflavin, from the clarified stream, to decolorize the clarified stream.

In another embodiment, the disclosure describes an example technique for purifying a supply stream including lactose. The example technique includes clarifying the supply stream by removing insoluble impurities to produce a clarified stream. The example technique also includes mixing the clarified stream with an adsorbent resin to produce a decolorized stream.

The details of one or more aspects of the invention are set forth in the accompanying drawings and the description below. Other features, objects, and advantages of the invention will be apparent from the description and drawings, and from the claims.

BRIEF DESCRIPTION OF DRAWINGS

The foregoing and other aspects of this invention are made more evident in the following Detailed Description, when read in conjunction with the attached Figures.

It should be understood the Figures present non-exclusive examples of the techniques disclosed herein.

DETAILED DESCRIPTION

Example systems and techniques per the disclosure may be used to prepare high purity lactose, for example, pharmaceutical-grade lactose. In some examples, systems and techniques according to the disclosure may be used to prepare high-purity products that may meet the requirements for regulatory approval. For example, the high purity products may meet requirements set forth in a pharmacopeia, for example, the U.S. pharmacopeia, EU pharmacopeia, or the Japanese pharmacopeia.

Example systems and techniques per the disclosure may include a clarification step, to remove calcium and other insoluble contaminants from the process stream. Without being bound by theory, reduction of the calcium and other insoluble contaminants is the first lactose purification step. In addition to purification, removal of the insoluble contaminants also produces a clarified lactose stream which will not plug downstream process stages, for example, an adsorption system.

A food-grade resin in an adsorption system (for example, in a packed-bed column) may be used to remove riboflavin from lactose solutions to produce pharmaceutical grade lactose. The packed-bed chromatography technique removes the need to repeatedly procure and supply fresh activated carbon. It also removes the need to further process the lactose solution to remove the spent carbon or filter aid, and eliminates the added cost and complications associated with disposing waste streams.

Various advantages are associated with the example systems and techniques per the disclosure. For example, the systems and techniques of the disclosure avoid issues associated with handling activated carbon; eliminate costs associated with purchasing activated carbon and filter aids; allow for continuous processing which can take full advantage of process automation; lower labor costs; eliminate by-products which require solid waste disposal (e.g., spent carbon and filter aids); produces high yields (almost 100%) of pharmaceutical grade lactose from edible grade-grade lactose by producing negligible losses (losses only limited to those normally associated with product handling in a hygienic process). An advantage of example systems per the present disclosure may include operation at high solids (e.g., 40% total solids) thereby eliminating the traditional requirement for evaporating the purified lactose stream prior to the final crystallization.

Figure 1:
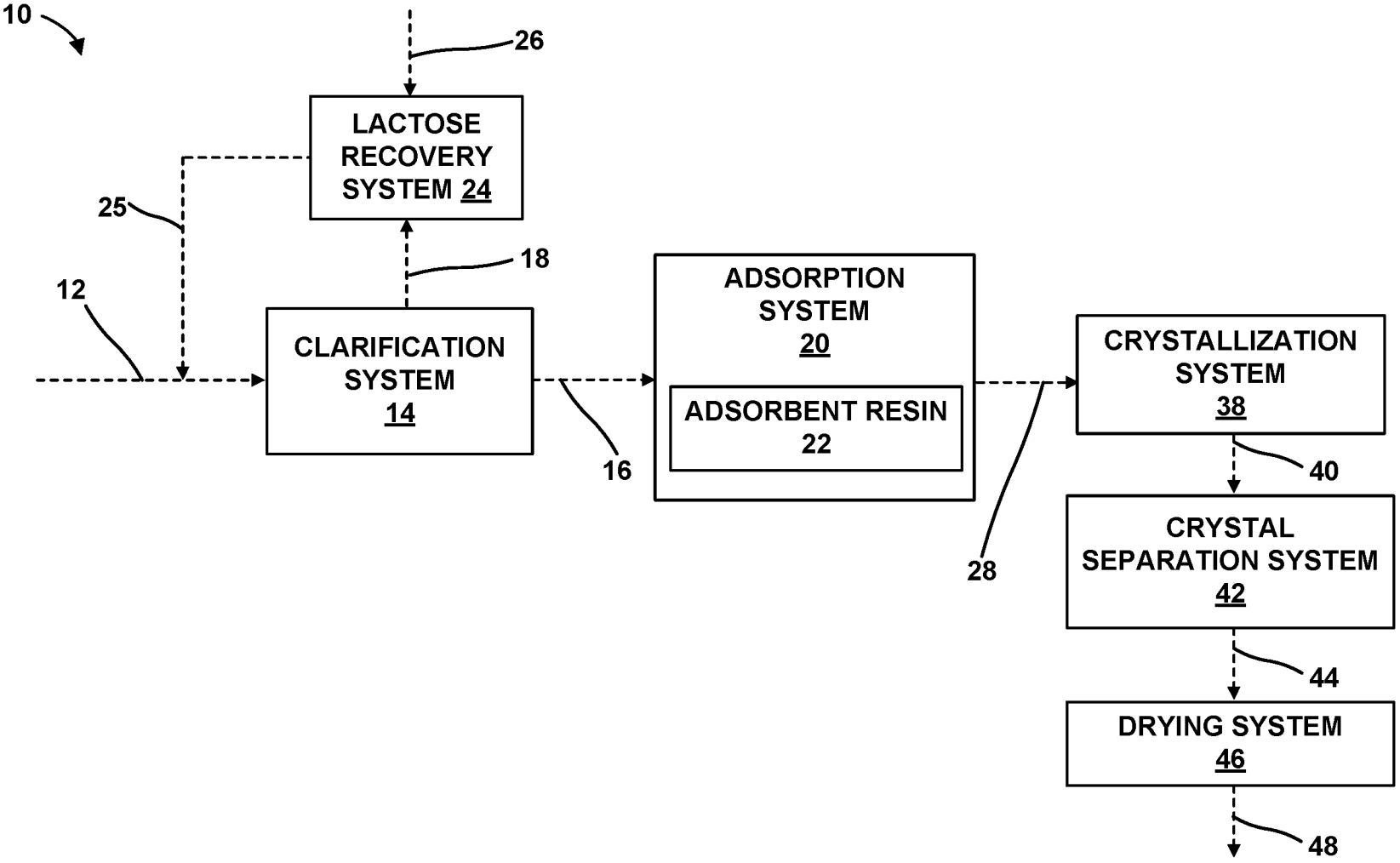
FIG. 1 is a schematic flow diagram illustrating an example system for processing lactose to obtain high purity lactose.

FIG. 1 is a schematic diagram illustrating an example system 10 for processing and refining lactose. System 10 includes a supply stream 12 that includes lactose. In some examples, supply stream 12 includes a solution of lactose in water, for example, a solution including a predetermined concentration of lactose in water. In some examples, supply stream 12 may include 40% weight/weight solution of lactose in water. In some examples, supply stream 12 may include lactose, for example, edible grade lactose. Supply stream 12 may exhibit a slightly yellow color and a turbid appearance, depending on the concentration of riboflavin, particulates, debris or contaminants in a lactose feedstock used to prepare supply stream 12.

In some examples, supply stream 12 may include solid lactose crystals suspended in a fluid, for example, water, and system 10 may optionally include a crystal solubilizing system (not shown). The crystal solubilizing system may dissolve the lactose crystals from supply stream 12 in water to produce a solution of lactose. For example, the crystal solubilizing system may include a tank, a mixer, or an inline mixer configured to agitate lactose crystals in water to cause lactose to dissolve into the water.

In some examples, supply stream 12 may include adding a base for adjusting the pH of the lactose solution to a basic pH. For example, supply stream 12 may include one or more of ammonium hydroxide ($NH_4OH$), potassium hydroxide (KOH), and sodium hydroxide (NaOH), $Na_2CO_3$, $NaHCO_3$, or another suitable inorganic or organic base. The base in the supply stream 12 may be in an amount sufficient to set pH within a predetermined pH range, without significantly altering the concentration of lactose in supply stream 12. The term "about" includes a pH deviation of ±0.5. For example, the pH may be between about 7 and about 11.

In some examples, supply stream 12 may be heated to maintain a temperature between about 60 and about 100° C., for example, at about 77° C. Without being bound by theory, presently available evidence indicates that the elevated temperature and basic pH will result in the precipitation of calcium salts. In some examples, calcium precipitation may be enhanced by the addition of an acid to provide an additional anion suitable for forming calcium precipitates, for example, carbonate ($CO_3^{-2}$), phosphate ($PO_4^{-3}$) or another suitable inorganic or organic acid anion. In some examples, the pH of supply stream 12 may be adjusted with a salt solution of high pH that contains anions which can cause calcium to precipitate. For example, a solution including sodium phosphates, sodium carbonates, and the like, may be used to raise the pH. Salts of these types may be used in combination with a base to induce the precipitation of calcium. Thus, various impurities may be primed for removal from supply stream 12.

System 10 includes a clarification system 14 for separating insoluble impurities from supply stream 12. In some examples, clarification system 14 may include a filter. For example, clarification system 14 may include any membrane filter capable of remaining stable at a relatively high pH and elevated temperature, for example, the pH and temperature ranges of supply stream 12 discussed above. In some examples, which are not intended to be limiting, the membrane filter may include one or more of cellulose-based, nylon, fluoropolymer, Teflon (also known as PTFE or polytetrafluoroethylene), polysulfone, polyethersulfone, modified polyethersulfone, or ceramic filtration media. In some examples, the filter has a predetermined molecular weight cutoff, for example, a cutoff that is sufficient to filter out calcium precipitates. For example, the filter may have a molecular weight cutoff in a range between about 10 kD and about 0.6 μm.

In some examples, clarification system 14 may include, in addition to a filter or instead of a filter, a centrifuge. For example, clarification system 14 may include a centrifugal clarifier that centrifuges supply stream to separate the insoluble impurities from supply stream 12, for example, based on the difference in the average density of the insoluble impurities.

Clarification system 14 receives supply stream 12, and separates predetermined impurities, for example, calcium precipitates, from supply stream 12 to filter supply stream 12 into a clarified stream 16 and a retentate stream 18. Clarified stream 16 includes lactose of higher purity compared to lactose in supply stream 12 and calcium and other insoluble impurities in a reduced concentration compared to supply stream 12. For example, clarified stream 16 may include a lower concentration of particulates, precipitants, or suspended impurities, compared to supply stream 12. In some examples, clarified stream 16 may include substantially no calcium ions. In some examples, clarified stream 16 is retained for further processing, or sent to a downstream processing stage. In some examples, retentate stream 18 may be recycled back for inclusion with the mother liquor by-product produced in the first crystallization process. Alternatively, the retentate containing primarily calcium salts can be diafiltered with water, dried and sold as milk minerals.

In some examples, system 10 may include a lactose recovery system 24 for recovering or refining lactose from retentate stream 18. For example, lactose recovery system 24 may receive a lactose feed 26 including lactose crystals, and may wash lactose crystals from lactose feed 26 with a wash medium. In some examples, lactose recovery system 24 may receive retentate stream 18 from clarification system 14, and use retentate from retentate stream 18 as the solution medium for dissolving lactose crystals from lactose feed 26. In some examples, lactose recovery system 24 may use retentate from retentate stream 18 mixed with fresh water as the wash medium.

Lactose recovery system 24 may include any suitable system for refining lactose crystals. Lactose recovery system 24 generates a refined stream 25 including washed lactose crystals. In some examples, refined stream 25 may include a wet cake, paste, or slurry of lactose. In some embodiments, refined stream 25 may be recirculated to supply stream 12, for example, after dissolving in water to generate a lactose solution. In some examples, at least a portion of refined stream 25 may not be recirculated to supply stream 12, and may instead be recovered as a side-product, for example, edible grade lactose.

In some examples, system 10 may include a melter that receives refined stream 25, and melts or dissolves lactose crystals in water to generate a lactose solution. In some examples, the melter may receive water from RO (reverse-osmosis), or purified water. In some examples, the lactose solution may be fed to supply stream 12. In some examples, one or both of lactose recovery system 24 and the melter may operate with clarification system 14 to ultimately recirculate retentate stream 18 into supply stream 12. Thus, in some examples, supply stream 12 may partly receive lactose from one or more of retentate stream 18, lactose feed 26, or a fresh supply of lactose from supply stream 12.

System 10 includes an adsorption system 20 for further purifying lactose in clarified stream 16 received from clarification system 14. Adsorption system 20 includes an adsorbent resin 22. In some examples, adsorbent resin 22 is capable of binding coloring agents from clarified stream 16 to decolorize clarified stream 16 to produce decolorized stream 28. For example, adsorbent resin 22 may be capable of binding riboflavin so that riboflavin is removed from a lactose solution passed over adsorbent resin 22. Riboflavin typically imparts a yellow color or tinge, so binding riboflavin reduces an intensity of at least a yellow component of the color of clarified stream 16 to produce decolorized stream 28. Adsorbent resin 22 may be disposed in adsorbent system 20 in any suitable configuration for sufficiently contacting clarified stream 16. For example, adsorbent system 20 may include a packed bed, a fluidized bed, or a stirred suspension of adsorbent resin 22. In some examples, adsorbent system 20 may include a stirred tank including adsorbent resin. Adsorbent resin 22 may include resin in the form of beads, pellets, rods, grains, or any other suitable form. While adsorbent resin 22 may be capable of decolorize a stream, for example, by removing colorants from the stream by adsorbing the colorants, adsorbent resin 22 may also purify the stream by removing other components, for example, contaminants. In some examples, the contaminants may include any components that may not be desired in the final lactose product.

In some examples, adsorbent resin 22 may include a food-grade or pharmaceutical-grade resin approved for use in systems that may process foods, pharmaceuticals, or other products for consumption. In some examples, adsorbent resin 22 may be a macroporous copolymer resin. In some examples, which are not intended to be limiting, the macroporous copolymer resin includes a monovinyl aromatic monomer and a crosslinking monomer, where the macroporous copolymer has been post-crosslinked in the swollen state in the presence of a Friedel-Crafts catalyst and functionalized with hydrophilic groups. In some examples, the monovinyl aromatic monomers used to prepare the macroporous copolymer may include styrene and its derivatives, for example, α-methylstyrene, vinyl toluene, vinyl naphthalene, vinylbenzyl chloride, and vinylbenzyl alcohol. An example macroporous copolymer that may be used is Dowex SD2 (Dow Chemical Company, Midland, Mich.), which is FDA-approved as a food additive. Dowex SD2, and other suitable macroporous copolymers, are described in U.S. Pat. No. 4,950,332, which is incorporated herein in its entirety by reference. Dowex SD2 exhibits little to no swelling, leading to better operability. Adsorbent resin 22 may adsorb contaminants such as riboflavin, proteins, and Maillard reaction products to purify lactose in clarified stream 16. Thus, apart from decolorizing, adsorbent resin 22 may also increase the purity of lactose obtained in decolorized stream 28.

In some examples, adsorbent resin 22 resin may be periodically desorbed or regenerated, as described below. Adsorption system 20 discharges a decolorized stream 28 including a lactose solution of a higher purity (for example, having a lower concentration of contaminants such as riboflavin, proteins, or other non-lactose components) compared to lactose in clarified stream 16.

Decolorized stream 28 may be further processed to crystallize and extract lactose crystals, to ultimately form lactose powder of a predetermined purity. In some examples, system 10 may include a crystallization system 38. Crystallization system 38 receives decolorized stream 28, and crystallizes crystals of purified lactose from decolorized stream 28 to generate a slurry stream 40 including lactose crystals suspended in an aqueous medium. Crystallization system 38 may include, for example, one or more evaporators that concentrate the lactose solution by removing water, and cool and agitate the concentrated lactose solution to initiate lactose crystal formation and uniform growth. In some examples, crystallization system 38 may include a series of crystallization stages including evaporators having agitators for concentrating and crystallizing lactose crystals from decolorized stream 28 to form slurry stream 40. Slurry stream 40 may include a cake, slurry, or paste of lactose crystals.

In some examples, system 10 may include a crystal separation system 42, which receives slurry stream 40, and separates lactose crystals in slurry stream 40 from the medium, to generate crystal stream 44. In some examples, crystal separation system 42 may include a decanter, a gravity settler, a centrifuge, a screen, a mesh, or other suitable apparatus for separating lactose crystals from the mother liquor in slurry stream 40.

In some examples, system 10 may include a drying system 46. Drying system 46 may receive slurry stream 40 or crystal stream 44, and dries lactose crystals in slurry stream 40 or crystal stream 44 to a predetermined dryness, to generate dry lactose stream 48. Drying system 46 may be configured to dry lactose crystals in slurry stream 40 or crystal stream 44 into a friable material. Drying system 46 may be configured to dry lactose crystals by removing additional water so that dry lactose stream 48 that exits the drying system 46 has a solids content of at least about 92 wt. % TS, such as at least about 94 wt. % TS, for example at least about 94.9 wt. % TS. Lactose produced by crystallization contains 5.00% water of hydration. Therefore, a dried lactose product will preferably contain less than 0.1% free moisture to prevent caking and molding in storage. Drying system 46 may include, for example, an oven, a spray dryer, a drum dryer, or a fluidized bed dryer. The dry lactose stream 48 may further be subjected to milling or other granulation processes to arrive at a predetermined particle size and distribution of lactose. Drying system 46 may also include a dryer capable of removing virtually all of the water of hydration to produce anhydrous lactose. Alternatively, the product stream 28 can be crystallized and dried at a temperature above 93.5° C. to produce beta-lactose rather than alpha-lactose monohydrate.

Thus, system 10 may be used to purify relatively low-grade lactose (such as edible grade lactose) in supply stream 12 to a predetermined purity, for example, a pharmaceutical-grade lactose product. In some examples, the pharmaceutical-grade lactose product may have less than 5.1% by weight of water, less than 0.1% sulphated ash, and less than about 5 μg/g of heavy metals. Protein and light-absorbing impurities may be less than an amount exhibiting an absorbance of less than 0.27 at 210-220 nm, and less than 0.07 at 270-300 nm. In some examples, the lactose product according to the disclosure may include lactose monohydrate, for example, crystalline α-lactose monohydrate. In some examples, the lactose product may include no more than 0.1 by weight % residue on ignition, no more than 5 μg/g of heavy metals, no more than 0.04 absorbance per path length in cm at a wavelength of 400 nm.

Figure 2:
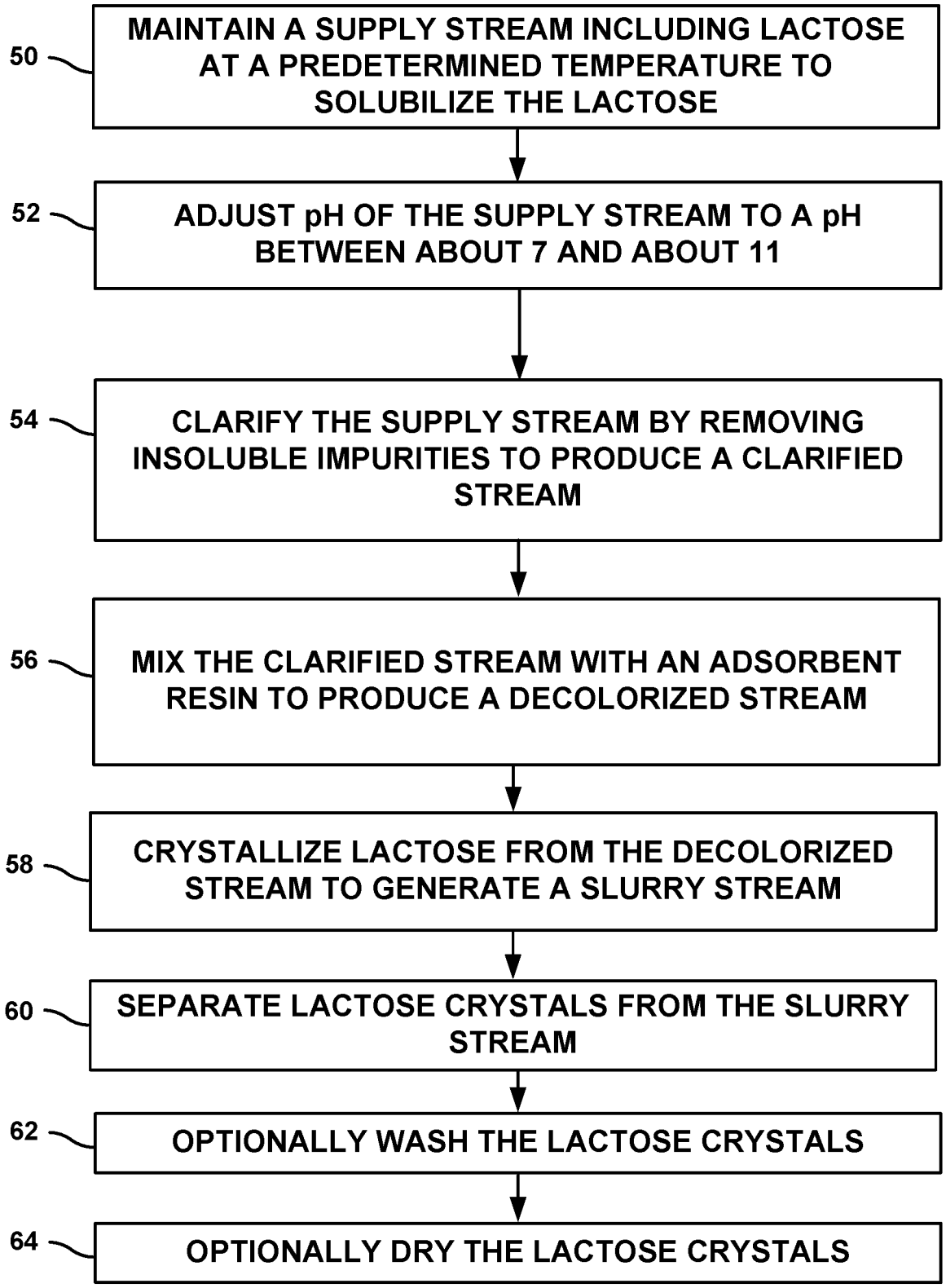
FIG. 2 is a flowchart illustrating an example process for preparing high purity lactose.

FIG. 2 is a flowchart illustrating an example technique for purifying lactose in a supply stream. While the example technique of FIG. 2 is described with reference to example system 10 of FIG. 1, the example technique of FIG. 2 may be implemented using other suitable example systems.

In some embodiments, the process of FIG. 2 includes maintaining supply stream 12 at a predetermined temperature to solubilize lactose (50) before passing supply stream 12 through clarification system 14. For example, the maintaining may include heating supply stream 12 to a temperature between about 60 and about 100° C. (50). In some examples, supply stream 12 may be heated to about 77° C.

In some embodiments, the example technique of FIG. 2 includes adjusting pH of supply stream 12 to a pH between about 7 and about 11 (52) before passing supply stream 12 through clarification system 14. As discussed with reference to system 10, heating supply stream 12 and maintaining an alkaline pH promotes the precipitation of calcium salts, which can be subsequently separated from supply stream 12. Without being bound by theory, removing calcium salts and other insoluble impurities partially purifies the supply stream 12 and prevents plugging of the adsorption system 20.

The example technique of FIG. 2 includes clarifying supply stream 12 by removing insoluble impurities from supply stream 12, for example by passing supply stream 12 through clarification system 14 to produce clarified stream 16 (54). As discussed above with reference to FIG. 1, clarification system 14 may include a centrifugal clarifier or a membrane filter medium having a predetermined molecular weight cutoff configured to remove insoluble impurities from supply stream 12. In some examples, the insoluble impurities may include calcium salts, proteins and other insoluble constituents. Clarification system 14 separates supply stream 12 into a clarified stream 16 to be processed further and a retentate stream 18, which may be recycled upstream. In some examples, supply stream 12 may be passed through clarification system 14 as part of a recycle stream, for example, via retentate stream 18 through lactose recovery system 24, as described above with reference to FIG. 1.

In some examples, the example technique of FIG. 2 includes, before passing supply stream 12 through clarification system 14, rinsing a component of clarification system, for example, a filter medium or a centrifugal tank, with water. This may assist with removing debris or residual impurities, for example, from a previous clarification.

The example technique further includes mixing clarified stream 16 with adsorbent resin 22, for example, by passing clarified stream 16 through adsorption system 20 comprising adsorbent resin 22. The mixing decolorizes clarified stream 16 to produce decolorized stream 28 (56). In some examples, adsorbent resin 22 may be arranged in a packed bed. Clarified stream 16 may be pumped across a packed bed of resin 22 of adsorption system 20 at a predetermined volumetric flow rate. For example, clarified stream 16 may be pumped at a rate of about 15 bed volume/hour. In some examples, clarified stream 16 is loaded onto adsorbent resin 22 at a rate between about 4 and about 20 bed volumes per hour. The temperature of clarified stream 16 may be maintained at a temperature high enough to maintain all lactose in solution; typically, between about 60 and about 100° C., for example, at 77° C. As described with reference to FIG. 1, adsorbent resin 22 decolorizes lactose by binding coloring agents or impurities such as riboflavin. Thus, adsorbent system 20 produces a decolorized stream 28.

As adsorbent resin 22 commences to absorb riboflavin and other contaminants, its capacity to remove contaminants from clarified stream 16 may decrease to unacceptably low levels. For example, adsorbent resin 22 should typically remove all color, for example, yellow color, so that decolorized stream 28 is substantially or completely clear or transparent. As the capacity of adsorbent resin 22 declines, for example, as the resin approaches saturation, stream 28 may begin exhibiting a color, for example, a yellow color from increasing riboflavin concentration. Yellow color associated with riboflavin may be detected using a spectrophotometer, to measure absorption at a wavelength between 400 to 465 nm, for example, at 450 nm. Collection of the effluent may be paused or stopped when decolorized stream 28 exhibits a yellow color. Adsorbent resin 22 may be periodically washed, replaced, refreshed, or regenerated. In some examples, collection of effluent may be stopped after about 10 bed volumes. In some examples, the flow rate of clarified stream 16 may be set so that adsorbent resin 22 needs to be washed only once in a production period or production shift, for example, once every day, or once every 12 hours, or any other suitable period. A regeneration regimen may include treating the resin bed with a solution or series of solutions including agents such as dilute caustic, dilute acid, NaCl, and hot water.

The amount of adsorbent resin 22, for example, the ratio of weight of processed lactose to the weight of resin depends on the source of the lactose. All other parameters remaining the same, a lactose source containing a higher proportion of riboflavin will entail the use of a higher amount of resin. The dimensions of adsorbent resin 22, for example in a packed bed, depend on linear flow rate, solution viscosity, and resin parameters. While the example technique of FIG. 2 is described with reference to a packed bed of adsorbent resin 22, it will be appreciated that adsorbent system 20 may include adsorbent resin 22 in other suitable configurations, for example, as a fluidized bed, or as a stirred suspension, as described with reference to FIG. 1.

In some examples, the example technique of FIG. 2 may further include recirculating lactose, for example, from one or more of supply stream 12, clarified stream 16, or decolorized stream 28, through one or both of clarification system 14 and adsorption system 20. In some examples, before initiating the passing of clarified stream 16 through adsorption system 20, the example technique of FIG. 2 may include washing adsorption system 20 with a predetermined volume of a basic solution (a solution having pH greater than about 7.0). For example, adsorption system 20 may be washed with about two bed volumes (BV) of 0.1 N NaOH solution. In some examples, after washing adsorption system 22 with the basic solution, adsorption system 20 may be rinsed with a predetermined volume of water, for example, about two bed volumes of water. In some examples, one or both of before initiating the passing of clarified stream 16 through adsorption system 20 or after washing adsorption system 20 with the basic solution, adsorption system 20 may be washed with an acid solution, followed by a second rinsing with water.

In some examples, the example technique of FIG. 2 may further include cooling decolorized stream 28 to induce the crystallization of lactose (58). In some examples, decolorized stream 28 may be cooled to promote lactose crystallization. For example, the crystallization may include cooling to a temperature lower than about 20° C., such as 16° C. The cooling will form a slurry stream 40 including crystallized lactose. Lactose crystals may be separated from slurry stream 40 by passing slurry stream 40 through crystal separation system 42 (60). Crystal separation system 42 may include one or more techniques such as gravity settling, decanting, centrifugation, screening, or other techniques to produce a dewatered crystal stream 44.

In some examples, the example technique of FIG. 2 may optionally include washing the separated lactose crystals in crystal stream 44 (62). In some examples, lactose crystals in crystal stream 44 may be washed with water to remove minor contaminants adhering to the surface of lactose crystals. For example, lactose crystals may be washed with about 0.5 weight unit of water per 1 weight unit of lactose. In some examples, lactose crystals may be centrifuged after the washing to remove the wash water.

In some examples, the example technique of FIG. 2 may optionally include drying the lactose crystals (64). For example, lactose crystals from crystal stream 44 may be dried using drying system 46, to produce dry lactose stream 48. In some examples, dry lactose stream may be subjected to further processing, for example milling, to produce lactose crystals of predetermined particle size and distribution.

The example technique of FIG. 2 may thus be used to purify lactose in supply stream 12 to obtain dry lactose stream 48 containing lactose having a predetermined purity, for example, a pharmaceutical grade lactose product.

Various examples of the invention have been described. These and other examples are within the scope of the following claims.

The invention claimed is:

1. A system for purifying a supply stream containing lactose, the system comprising:

a clarification system configured to remove insoluble impurities from the supply stream to produce a clarified stream, wherein the lactose in the supply stream is produced by concentrating cheese whey or deproteinized cheese whey; and an adsorption system fluidically coupled to the clarification system, wherein the adsorption system comprises an adsorbent resin selected to bind riboflavin adsorbed to the surface of lactose crystals in the clarified stream to decolorize the clarified stream, wherein the adsorbent resin comprises a riboflavin-binding macroporous copolymer resin comprising:

a monovinyl aromatic monomer selected from styrene and styrene derivatives chosen from α-methylstyrene, vinyl toluene, vinyl naphthalene, vinylbenzyl chloride, and vinylbenzyl alcohol, and a crosslinking monomer, where the macroporous copolymer has been post-crosslinked in a swollen state in the presence of a Friedel-Crafts catalyst and functionalized with hydrophilic groups.

2. The system of claim 1, wherein the adsorption system comprises a packed bed comprising the adsorbent resin.

3. The system of claim 1, wherein the clarification system comprises a membrane filter having a predetermined molecular weight cutoff configured to remove the insoluble impurities.

4. The system of claim 1, wherein the clarification system comprises a centrifugal clarifier configured to remove the insoluble impurities.

5. The system of claim 1, further comprising one or more of a crystallization system configured to crystallize lactose crystals, a crystal separation system configured to separate lactose crystals from a solution, and a drying system configured to dry lactose crystals.

6. The system of claim 1, further comprising a lactose recovery system configured to wash lactose from a stream received from the crystallization system.

7. A method for purifying a supply stream comprising lactose, the method comprising:

clarifying, by a clarification system, the supply stream by removing insoluble impurities to produce a clarified stream, wherein the lactose in the supply stream is produced by concentrating cheese whey or deproteinized cheese whey; and mixing, by an absorption system fluidically coupled to the clarification system, the clarified stream with an adsorbent resin selected to bind riboflavin adsorbed to the surface of lactose crystals in the clarified stream to produce a decolorized stream, wherein the adsorbent resin comprises a macroporous copolymer resin comprising:

a monovinyl aromatic monomer selected from styrene and styrene derivatives chosen from α-methylstyrene, vinyl toluene, vinyl naphthalene, vinylbenzyl chloride, and vinylbenzyl alcohol, and a crosslinking monomer, where the macroporous copolymer has been post-crosslinked in a swollen state in the presence of a Friedel-Crafts catalyst and functionalized with hydrophilic groups, and wherein the macroporous copolymer resin is a riboflavin-binding resin.

8. The method of claim 7, wherein the adsorbent resin is arranged in a packed bed.

9. The method of claim 7, wherein the clarifying comprises passing the stream through a membrane filter having a predetermined molecular weight cutoff configured to remove the insoluble impurities.

10. The method of claim 7, wherein the clarifying comprises centrifuging the stream in a centrifugal clarifier to remove the insoluble impurities.

11. The method of claim 7, further comprising maintaining the supply stream at a predetermined temperature of between 60 and 100° C. to solubilize lactose in the supply stream.

12. The method of claim 7, further comprising adjusting pH of the supply stream to a pH between 7 and 11.

13. The method of claim 7, further comprising recirculating lactose from a retentate stream into the supply stream.

14. The method of claim 7, further comprising cooling the decolorized stream to a predetermined second temperature to crystallize lactose crystals from the decolorized stream to produce a slurry stream.

15. The method of claim 14, wherein the predetermined temperature is 16° C.

16. The method of claim 14, further comprising separating lactose crystals from the slurry stream.

17. The method of claim 16, further comprising one or both of washing the lactose crystals or drying the lactose crystals.

* * * * *